US008567321B2

(12) United States Patent
Jarnes

(10) Patent No.: US 8,567,321 B2
(45) Date of Patent: Oct. 29, 2013

(54) COMPUTER TABLE FOR A FURNITURE

(75) Inventor: Webjorn Jarnes, Ikornnes (NO)

(73) Assignee: Ekornes ASA, Ikornnes (NO)

( * ) Notice: Subject to any disclaimer, the term of this patent is extended or adjusted under 35 U.S.C. 154(b) by 0 days.

(21) Appl. No.: 13/496,800

(22) PCT Filed: Oct. 19, 2010

(86) PCT No.: PCT/NO2010/000368

§ 371 (c)(1),
(2), (4) Date: May 16, 2012

(87) PCT Pub. No.: WO2011/049460

PCT Pub. Date: Apr. 28, 2011

(65) Prior Publication Data

US 2012/0255466 A1 Oct. 11, 2012

(30) Foreign Application Priority Data

Oct. 19, 2009 (NO) ..... 20093165

(51) Int. Cl.
*A47F 5/12* (2006.01)

(52) U.S. Cl.
USPC ..... 108/6

(58) Field of Classification Search
USPC ..... 108/1, 3, 6, 7, 8, 115; 248/454, 456, 248/457, 458, 406.1, 411, 410
See application file for complete search history.

(56) References Cited

U.S. PATENT DOCUMENTS

| | | | | | |
|---|---|---|---|---|---|
| 800,090 | A | * | 9/1905 | Enander | 108/6 |
| 922,565 | A | * | 5/1909 | Cole | 108/6 |
| 1,082,997 | A | * | 12/1913 | Braasch | 108/6 |
| 1,307,784 | A | * | 6/1919 | Mackey | 108/6 |
| 2,312,636 | A | * | 3/1943 | Froelich | 108/6 |
| 2,472,549 | A | * | 6/1949 | Schulze | 108/6 |
| 2,632,496 | A | * | 3/1953 | Cardozo, Jr. et al. | 108/6 |
| 2,692,806 | A | * | 10/1954 | Grace | 108/143 |
| 2,994,366 | A | * | 8/1961 | Hoch | 108/6 |
| 3,640,228 | A | * | 2/1972 | Busse | 108/6 |
| 4,278,032 | A | * | 7/1981 | Kritske | 108/6 |
| 4,672,898 | A | * | 6/1987 | Davidson | 108/6 |
| 4,956,929 | A | * | 9/1990 | Chirabandalsuk | 108/6 |
| 5,927,662 | A | * | 7/1999 | West et al. | 108/6 |

(Continued)

FOREIGN PATENT DOCUMENTS

| | | |
|---|---|---|
| FR | 2880403 | 7/2006 |
| GB | 431311 | 7/1935 |
| WO | WO 2011/049460 | 4/2011 |

OTHER PUBLICATIONS

International Search Report, Int'l. Application No. PCT/NO2010/000368, Mailing Date: Mar. 23, 2011; 4 pages.

(Continued)

*Primary Examiner* — Jose V Chen
(74) *Attorney, Agent, or Firm* — Seyfarth Shaw LLP

(57) ABSTRACT

A fixing device for a table top. The table top having a profile installed into the table top. The profile can be cast-in into the table top, or the table top can be laminated around the profile. The profile includes a through bore having a number of longitudinal grooves. A shaft is arranged to be directed through the bore. A sleeve terminates the shaft at one end. The sleeve includes a number of locking lugs arranged to engage into the grooves of the profile.

13 Claims, 2 Drawing Sheets

(56) References Cited

U.S. PATENT DOCUMENTS

| | | | | |
|---|---|---|---|---|
| 8,161,890 | B2 * | 4/2012 | Wang | 108/6 |
| 8,336,840 | B2 * | 12/2012 | Song et al. | 108/6 |
| 2003/0140822 | A1 * | 7/2003 | Seiler et al. | 108/6 |
| 2005/0005827 | A1 | 1/2005 | Chang | |
| 2006/0003155 | A1 | 1/2006 | Stewart | |
| 2007/0261609 | A1 * | 11/2007 | Kumazawa | 108/6 |
| 2008/0295742 | A1 * | 12/2008 | Henriott | 108/6 |
| 2009/0272860 | A1 * | 11/2009 | Reinke | 108/6 |
| 2010/0095565 | A1 * | 4/2010 | Ma et al. | 108/6 |

OTHER PUBLICATIONS

Norwegian Serach Report; Patent Application No. 20093165; Date of Report: Jan. 19, 2010.

* cited by examiner

COMPUTER TABLE FOR A FURNITURE

This application is a U.S. National Phase of International Patent Application Serial No. PCT/NO2010/000368 filed Oct. 19, 2010, and claims priority to Norwegian Application Serial No. NO 20093165 filed Oct. 19, 2009.

FIELD OF THE INVENTION

The present invention relates to a fixing device for table top, a profile being an integral part of the fixing device as well as a table top utilizing the fixing device. The fixing device can be utilized for all types of tables having free-hanging table tops, and especially for computer tables.

BACKGROUND OF THE INVENTION

It is prior known tables for computer screens, raising the screen up from the desk. The screen is placed on a small plate. The plate is mounted on a rotating arm, which again is standing on a clamp fastener gripping round the rim of the desk.

In the prior known solutions, the table top is fixed to a rotating joint or an arm by means of a small bracket which again is fixed to the desk with bolts, rivets or similar. This fixing point is a weak point mechanically speaking, requiring space and is therefore not allowing a slim mounting of the plate, and is not much satisfactory from an aesthetic point of view.

Thus, there is a demand of an improved fixing device which being more solid and stable in use, simultaneously providing an improved visual expression than existing solutions.

SUMMARY OF THE INVENTION

The object of the present invention is to provide such a fixing device, a profile for embedding into a table top as well as a table top utilizing such a fixing device. The extent of the invention is evident from the following patent claims.

According to a first aspect, the invention comprises a fixing device for table top comprising a profile arranged to be fixed in the table top, wherein the profile comprises a through bore, a shaft arranged to be directed through the bore, a sleeve terminating the shaft at one end as well as a fixing means terminating the shaft at the other end.

According to a second aspect, the invention comprises a profile for fixing table top comprising a flat base having a curved or double curved upper surface and a through channel provided with a circular bore having a number of longitudinal grooves.

According to a third aspect, the invention comprises a table top as with a fixing device according to said first aspect.

BRIEF DESCRIPTION OF THE FIGURES

The invention is now described in more detail by reference to the attached drawings, wherein.

DETAILED DESCRIPTION

Computer table of the type described herein comprises a plate that shall hold the computer, more specifically a portable computer, often named laptop. The computer table comprises an arm holding the table top itself, and which again is fixed on a furniture. It must be possible to rotate said arm out and in of the working area of the user, thereby ensuring that it simply can be placed in correct working position and be turned away when it is not in use.

Figure 1:
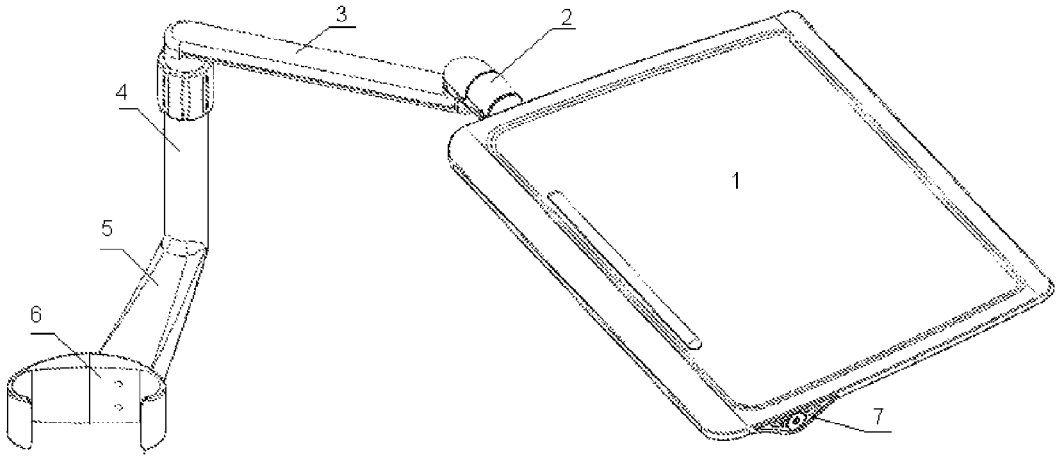
FIG. 1 is a drawing of a computer table.

FIG. 1 shows a computer table according to the invention comprising a table top 1. The table top is fixed to a rotatable joint 2 which again is fixed to an upper arm 3. The upper arm is fixed to a rotating telescopic arm or pillar 4, which again is fixed to a lower arm 5 and a clamp fastener 6. The clamp fastener is estimated to be able to grip round an arm rest, or another suitable component, of a chair, such as a recliner.

Figure 2:
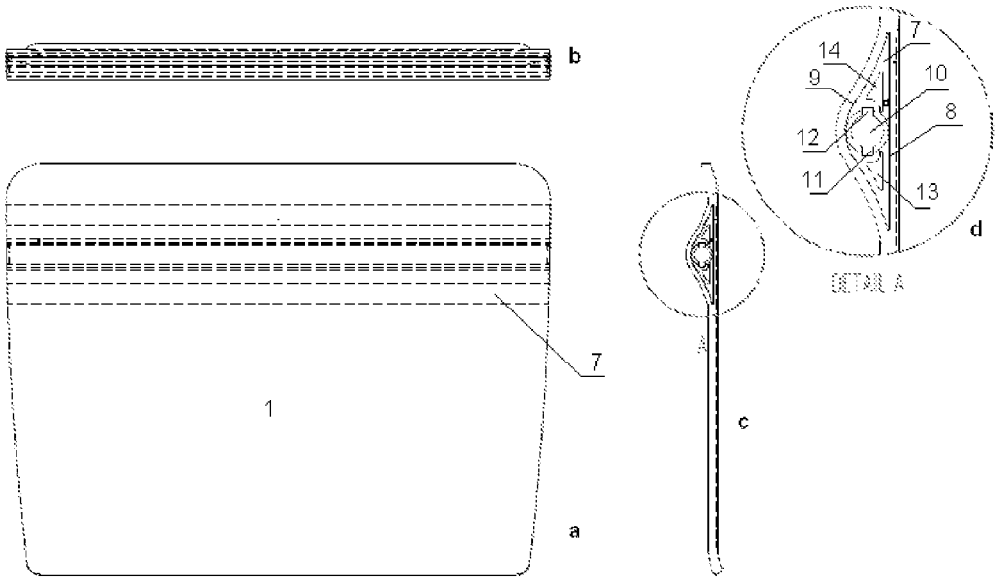
FIG. 2 is showing schematically a table top according to the invention, a seen from above, b schematically from in front, c in cross section, and d a detail from the section c, respectively.

The table top 1 comprises a through profile 7 (FIG. 2) being installed into the table top. The profile is preferably manufactured from metal, such as aluminum, or alternatively from a synthetic material such as fibre reinforced plastic composite. The profile can be installed into the table top by being cast-in, or by the plate consisting of several layers which are laminated round the profile. Thus, the profile is suitable both to table tops made from synthetic material, laminated synthetic material, and laminated wood.

Sectionally, the profile has a flat base 8 having a curved or double curved upper surface 9. Further, the profile has a through channel. The channel is in form of a circular bore 10 having a longitudinal groove 11, 12 on each side. It can be fewer or more longitudinal grooves, as required. On each side of this channel, there are two side channels 13, 14 which are able to remove redundant material.

Figure 3:
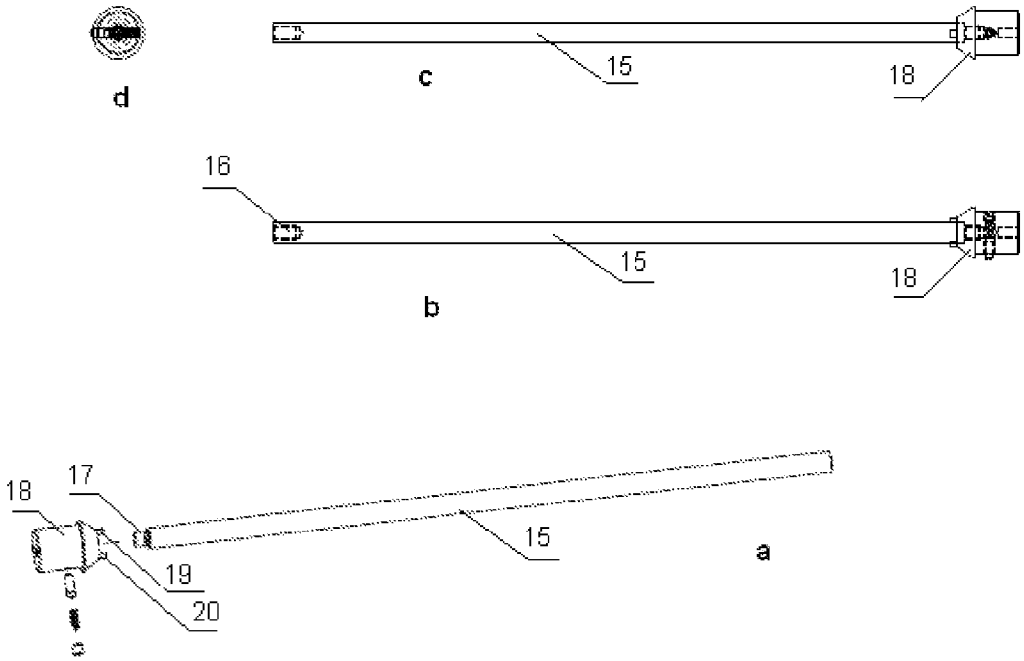
FIG. 3 is showing single components being an integral part of the fixing device, a exploded in perspective, b composed in longitudinal sections from the side, c seen from above, and d in cross section, respectively.

FIG. 3 shows the arrangement fixing the table to the rotating joint 2. The arrangement comprises a shaft 15 estimated to be treaded into the bore 10. The shaft has at the one end a threaded part 17 which is to be screwed in on a sleeve 18. The sleeve 18 has two locking lugs 19, 20 arranged to engage into the grooves 11, 12 of the profile 7. Thus, the is table will be locked to the sleeve 18 and rotate this one in the joint 2, without the shaft being exposed of any rotating moment. At the other end, the shaft 15 is locked with a suitable fixing means. In the embodiment shown, this is a threaded bore 16 which can admit a bolt. The shaft can of course be fixed in many ways.

This arrangement is advantageous by being simple to mounting and dismounting the table top, e.g., if it is desired to mount a computer table on opposite side of the chair. As the table top is held firmly by one screw only, it can easily be taken off and treaded on the shaft from opposite side.

The invention claimed is:

1. A table top comprising:

a profile installed into material of the table top, wherein the table top is formed by several layers being laminated around the profile, wherein the profile has a through bore, a flat base on one side of the through bore and a curved or double curved surface on the opposite side of the through bore, wherein a first section of one of the layers is contacting the flat base of the profile and a first section of another of the layers is contacting the curved or double curved surface of the profile, the layers being in direct contact on the table top outside the area occupied by the profile.

2. The table top according to claim 1, wherein the profile is made from a fiber reinforced composite material or metal.

3. The table top according to claim 1, wherein the profile is made from aluminum.

4. The table top according to claim 1, wherein, in cross profile, a width of the profile is larger than a height of the profile.

5. The table top according to claim 1, wherein a width to a height ratio of the profile is 30:7.

6. The table top according to claim 1, wherein the through bore is longitudinal and adapted to receive a shaft for mounting the table top.

7. The table top according to claim 6, wherein the profile includes side channels on each side of the bore.

8. The table top according to claim 1, wherein the table top further comprises a shaft arranged to be directed through the through bore, a rotatable fixing means terminating the shaft at one end, and a means for locking the shaft to the table top.

9. The table top according to claim 8, wherein the profile includes a number of longitudinal grooves in and along the bore, and said means for locking the shaft to the table top including locking lugs arranged on the rotatable fixing means and being arranged to engage into the grooves and locking the profile and the table top against rotation around the shaft.

10. A table top comprising:

a profile installed into material of the table top, wherein the profile includes a through bore having at least one longitudinal groove in and along the through bore; wherein the table top further includes a shaft adapted to be directed through the through bore, a rotatable locking unit connected to the shaft at a first end of the profile, the rotatable locking unit including locking lugs disposed in the at least one longitudinal groove of the through bore, and a fixing unit adapted to lock the shaft to the table top at a second end of the profile.

11. The table top according to claim 10, wherein the profile has a flat base on one side of the through bore and a curved or double curved surface on an opposite side of the through bore, and wherein the table top is formed by several layers being laminated about the profile.

12. The table top according to claim 10, wherein the profile is composed of a fiber reinforced composite material or metal.

13. The table top according to claim 10, wherein the profile is composed of aluminum.

* * * * *